US006106491A

United States Patent [19]

Gianutsos

[11] Patent Number: 6,106,491

[45] Date of Patent: Aug. 22, 2000

[54] SHAKING DEVICE FOR TREATING PARKINSON'S DISEASE

[75] Inventor: John G. Gianutsos, Sunnyside, N.Y.

[73] Assignee: Weller Mobilizer, Inc., New York, N.Y.

[21] Appl. No.: 09/027,885

[22] Filed: Feb. 23, 1998

[51] Int. Cl.[7] ..... A61H 7/00

[52] U.S. Cl. ..... 601/104; 601/101; 601/98; 601/84; 601/27

[58] Field of Search ..... 601/84, 89, 90, 601/92, 93, 97, 98, 101, 104, 24, 27, 28, 29, 31, 112, 85–87

[56] References Cited

U.S. PATENT DOCUMENTS

| | | | |
|---|---|---|---|
| 3,035,570 | 5/1962 | Nelson . | |
| 3,695,255 | 10/1972 | Rodgers et al. . | |
| 3,742,941 | 7/1973 | Aizenstat . | |
| 3,789,836 | 2/1974 | Girten . | |
| 4,220,143 | 9/1980 | Cummins et al. | 601/90 |
| 4,862,875 | 9/1989 | Heaton . | |
| 5,107,822 | 4/1992 | Ohashi | 601/23 |
| 5,170,776 | 12/1992 | Pecheux . | |
| 5,176,598 | 1/1993 | Gardner . | |
| 5,203,321 | 4/1993 | Donovan et al. . | |
| 5,372,563 | 12/1994 | Chien-Nan . | |
| 5,417,644 | 5/1995 | Lee . | |
| 5,520,614 | 5/1996 | McNamara et al. | 601/24 |

OTHER PUBLICATIONS

"50 and 100 Years Ago", Scientific American, Oct. 1992, pp. 12–14.

*Primary Examiner*—Danton D. DeMille
*Assistant Examiner*—Benjamin Koo
*Attorney, Agent, or Firm*—Schweitzer Cornman Gross & Bondell LLP

[57] ABSTRACT

A device and method for treating the symptoms of Parkinson's disease involves a shaking device with a horizontally, linearly, sinusoidally reciprocating foot support pad connected to a motor via a flywheel and linkage mechanism enclosed in a housing. The motor, linkage and flywheel, as well as the foot support pad are slidably supported on a pair of rails within the housing. The motor-flywheel-linkage assembly and the foot support pad have opposite, complementary balancing motion to minimize the vibration induced to the housing of the shaking device. In the treatment method, the patient is placed on a support and the patient's foot is placed on the foot support pad, at which time the shaking device is activated for a period of time. The orientation of the shaking device and the positioning of the patient can be varied to direct the shaking effect induced in the patient's body to certain desired areas.

6 Claims, 5 Drawing Sheets

SHAKING DEVICE FOR TREATING PARKINSON'S DISEASE

This invention pertains to the field of medical devices and methods, and in particular, to a device and method for treating Parkinson's disease.

BACKGROUND AND SUMMARY OF THE INVENTION

Parkinson's disease ("PD") was first described in 1817 by James Parkinson in a paper entitled "An Essay on the Shaking Palsy". PD is characterized by slowing of movement, muscular rigidity, postural abnormality and tremor. The severity of the symptoms can vary from the merely inconvenient to completely disabling.

The precise cause of PD is as yet unknown; however drug treatment is commonly and effectively used to treat the symptoms of the disease. In addition, more recently, surgical treatment has been used to treat the disease.

It is also known that induced shaking of the body can reduce the symptoms of PD and provide at least temporary relief from the effects of the disease. For example, the Charcot Chair, which was invented by a Professor Charcot was developed from the relief from long rides in railroad or carriage cars. The Charcot Chair was essentially a full-size arm chair vibrated by an electric motor. The PD patient was placed in the chair which vibrated and shook the entire body of the patient indiscriminately. Another device developed by a Dr. Gilles de la Tourette, a pupil of Professor Charcot, was a vibrating helmet having a motor which induced vibrations at about ten cycles per second. Apparently, the helmet was somewhat effective in the treatment of migraines and nervous headaches; however, this treatment is necessarily limited to the treatment of the head and neck region. Therefore, what is desired is a novel, non-invasive, low-cost, portable and effective device and treatment method for Parkinson's disease, which can be directed toward certain areas of the body of the patient. The device of the present invention includes a housing which supports a linearly, horizontally reciprocating foot support for inducing shaking in the foot, ankle, leg and body of the patient. The housing encloses a motor and linkage which serve to reciprocate the foot support pad in a horizontal plane at an amplitude of approximately 1½ inches. The foot support pad preferably includes a non-skid surface and is situated at a height of approximately 7 inches off the ground, on which the housing of the shaking device is placed.

The housing contains a set of spaced-apart bars which slidably support an upper plate rigidly connected to the foot support pad. The bars also independently slidably support a lower plate to which the motor and drive linkage are attached. The lower plate is resiliently attached to the frame by a spring/shock-absorbing mechanism to locate and dampen the movement of the lower plate. The linkage of the shaking device consists of a fly wheel connected to the motor by a belt and a linkage arm pivotally connected to the fly wheel and the upper plate. Thus the rotation of the fly wheel induced by the motor causes the upper plate and the foot support pad attached thereto to reciprocate back and forth in a sinusoidal motion. The motion induced to the upper plate and foot support pad induces an opposite, complementary motion in the lower plate, linkage and motor. Thus, it can be appreciated that the motor and linkage induce movement in the foot support without causing substantial vibration in the housing. Furthermore, such balanced movement is not upset by resistance applied to the foot support pad by the foot of a patient.

The method of the present invention involves providing one of the above described shaking devices, placing the patient on a fixed support, such as a chair or bench above the shaking device, placing one or more feet of the patient on the foot support pad of the shaking device and inducing shaking in the foot, lower leg and body of the patient for a period of time. The shaking device can be oriented to reciprocate forward and backward relative to the patient or can be oriented to reciprocate laterally with respect to the patient. In addition, the patient can be positioned to vary and direct the induced shaking and the effects thereof on the body. For example, the patient can be placed or seated in a chair with the shaking device located under the outstretched leg of the patient, touching only the heel. Alternatively, the shaking device can be moved closer to the patient such that the entire sole of the foot contacts the foot support pad, or the patient can be placed such that only the ball or toe region of the foot touches the foot support pad. It will be appreciated that these different foot and leg positions will induce shaking in a body to different extents. In addition, the upper body of the patient can be positioned to vary the effect and extent of the shaking induced in the patient's body. For example, the patient's body can be positioned in a reclined or extended position to substantially limit the shaking induced in the body to the lower leg region. Alternatively, the patient can be positioned over (or actually standing) over the shaking device to induce shaking in substantially the whole body of the patient. Furthermore, the patient can be positioned in a any one of a multitude of positions between the two previously described extremes to optimize the effect and extent of the vibration induced in the body.

It can be appreciated that the device is relatively inexpensive to manufacture and thus it is available to a wide range of persons suffering from PD. In addition, the device is relatively small, lightweight and portable.

For a more complete understanding of the above, and other features and advantages of the invention, reference should be made to the following detailed description of the preferred embodiments of the invention and to the accompanying drawings.

DETAILED DESCRIPTION OF THE INVENTION

Figure 1:
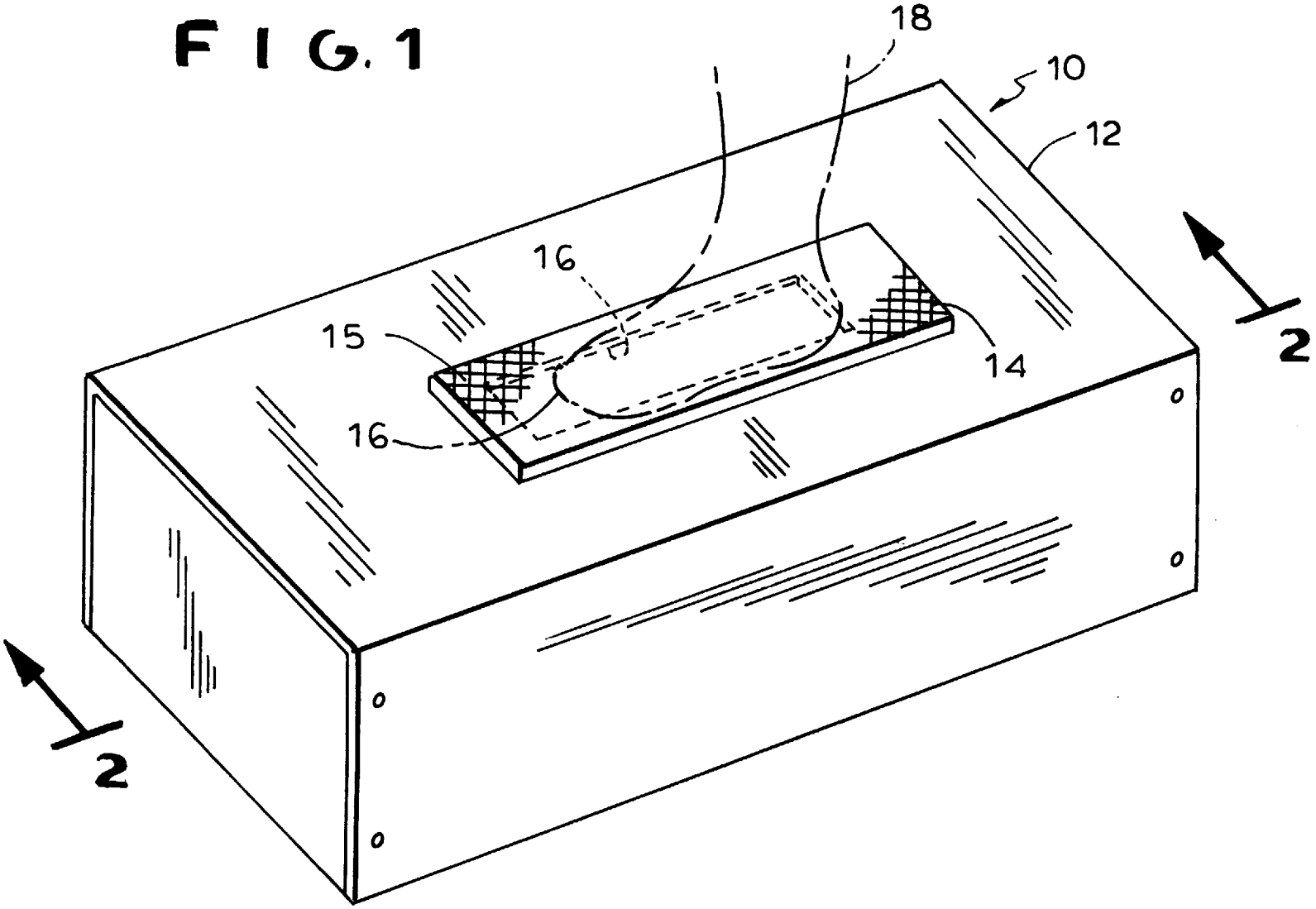
FIG. 1 is a perspective view of the shaking device of the present invention, from the top.

Referring to the drawings, and initially to FIG. 1 thereof, the shaking device 10 includes a housing 12 which encloses a motor and linkage (not shown) which oscillate a foot support pad 14 along a linear, horizontal path. The foot support pad 14 includes a substantially planar non-skid surface 15 such that when the foot 16 of a patient is placed on the foot support pad 14 and the shaking device 10 is activated, the shaking device 10 induces shaking and vibration in the foot 16, lower leg 18 and upwardly into the body of the patient.

Figure 2:
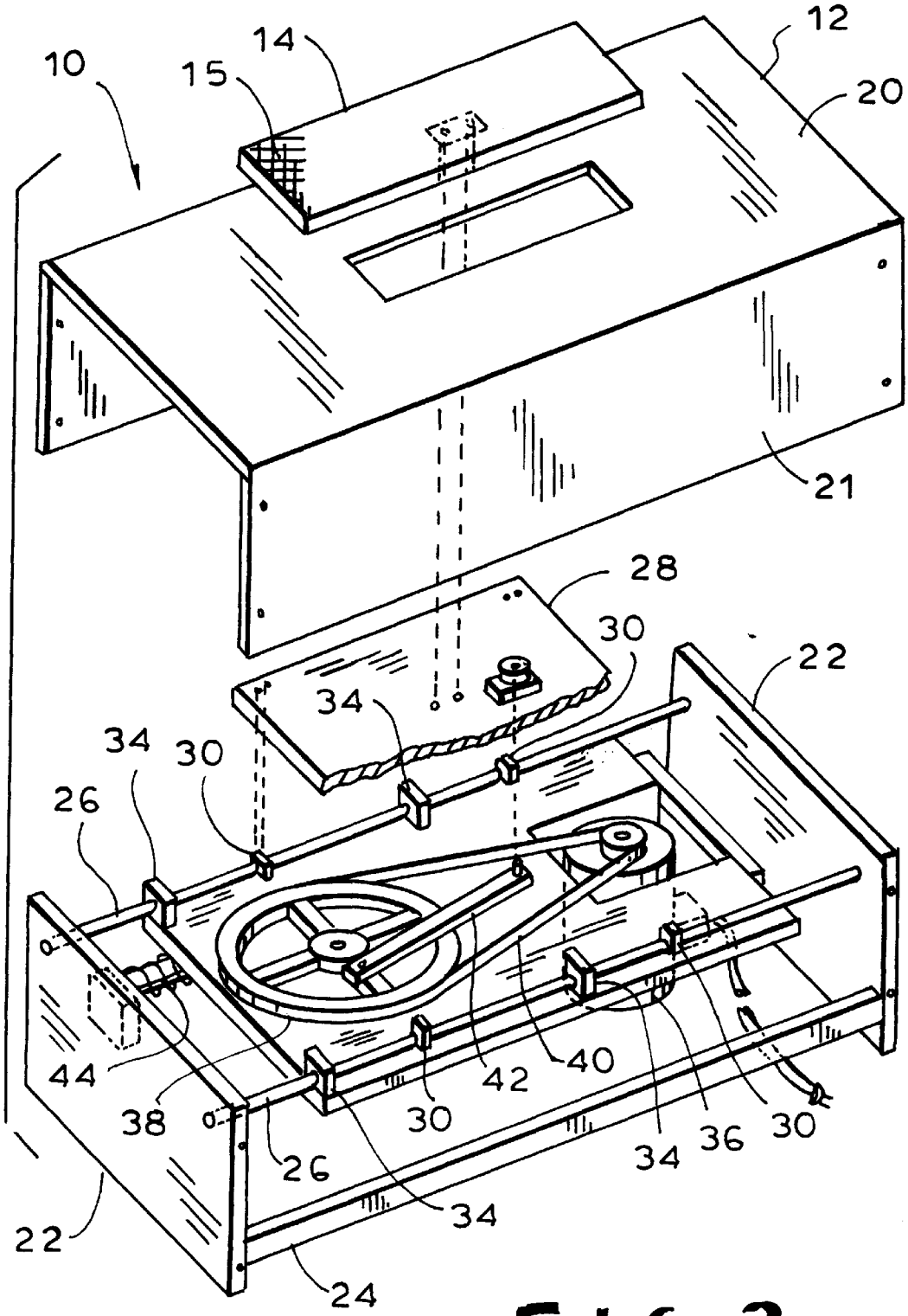
FIG. 2 is an exploded view of the shaking device of FIG. 1, illustrating the internal motor and linkage.
Figure 3:
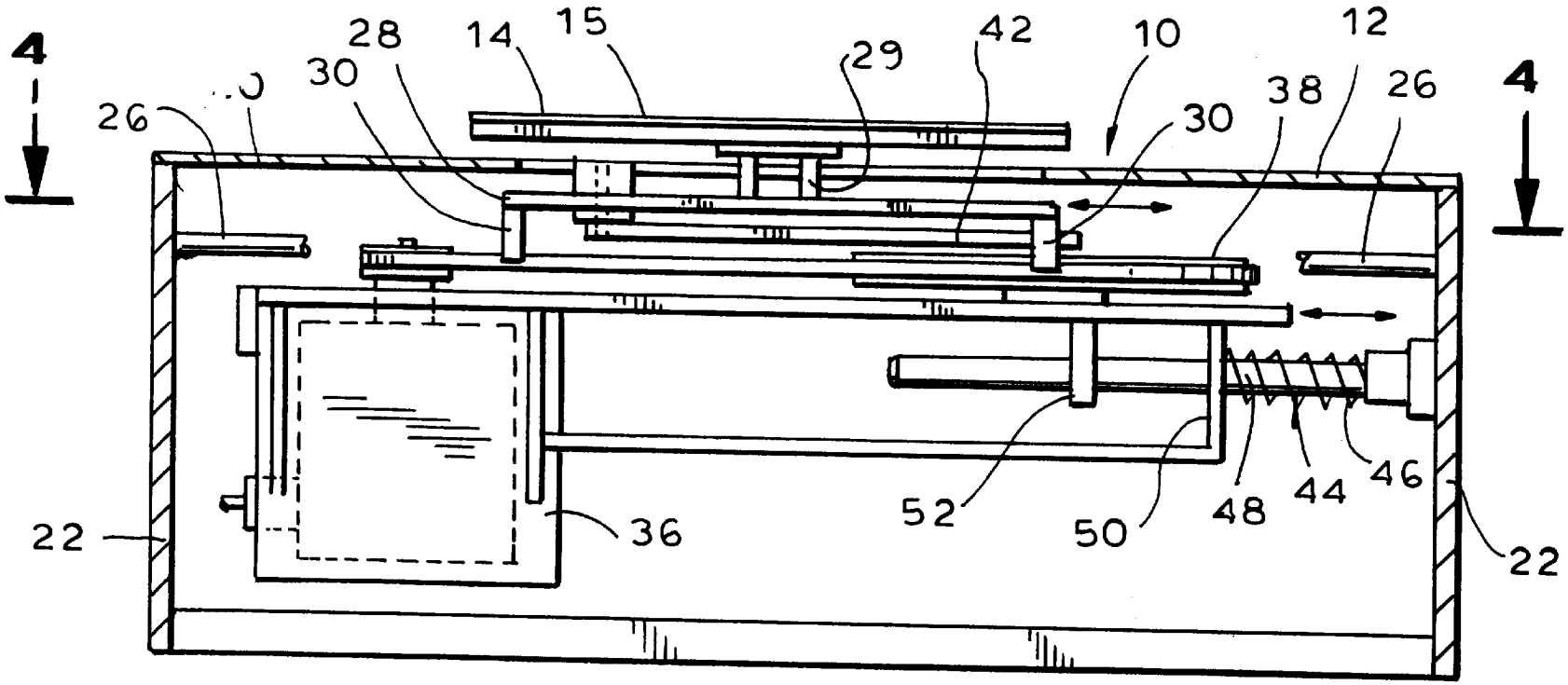
FIG. 3 is a side view of the shaking device taken along line 2—2 of FIG. 1.
Figure 4:
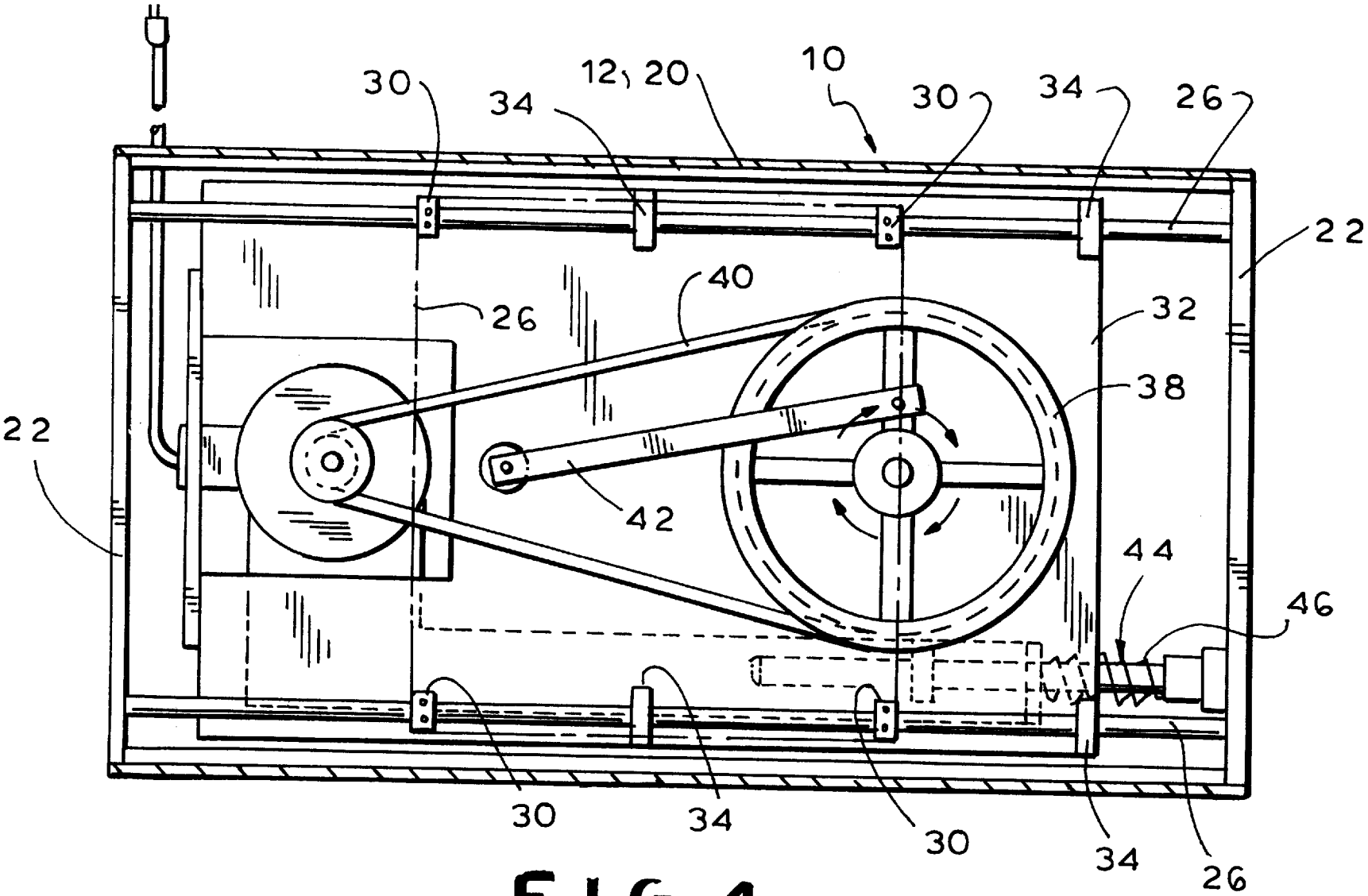
FIG. 4 is a cross sectional view of the shaking device taken along line 4—4 of FIG. 3.

Referring to FIGS. 2–3, the housing 12 of the shaking device 10 includes opposed side walls 22 and a top 20 with side portions 21. The side walls 22 are connected by lower support bars 24 and upper, parallel sliding support bars 26. The sliding support bars 26 slidably support an upper plate 28 on sliding blocks 30. The upper plate 28 is rigidly connected to the foot support pad 14 through a rigid linkage 29. The sliding support bars 26 also slidably support a lower plate 32 on a second set of sliding blocks 34. Rigidly connected to the lower plate 32 is a motor 36 which drives a belt 40 which, in turn, drives a fly wheel 38 pivotally connected to the lower plate 32. A linkage bar 42 is pivotally connected to both the fly wheel 38 and the upper plate 28. Therefore, it can be appreciated that when the motor 36 is activated, the rotation of the fly wheel 38 serves to drive the foot support plate 14 in a linear, horizontal sinusoidal reciprocating motion. The motion induced into the upper plate 28 and foot support pad 14 induces a complementary, opposite motion in the lower plate 32, linkage 29 and motor 36.

Thus, it can be appreciated that the complementary reciprocation of the lower plate 32/motor 36 and upper plate 28/foot support pad 14 effectively eliminate or minimize any vibration induced into the housing 12. Therefore, during operation the housing 12 and shaking device 10 remain virtually motionless while the foot support pad 14 reciprocates in a linear, horizontal path.

As best seen in FIG. 3, preferably the lower plate 32 is connected to one of the side walls 22 via a dampening means 44, which can include a rod 48 rigidly mounted to the side wall 22 and extending through a guide 50 attached to the lower surface of the lower plate 32. A spring 46 is connected to the side wall 22 and the guide 50 to bias the lower plate 32 in a rest position. The rod 48 can also extend through a friction damping block 52 extending downwardly from the lower support plate 32. Thus, it can be appreciated that due to the spring/damping means, the lower plate 32 and motor 36 attached can reciprocate in response to the motion induced in the upper plate 28 and foot support pad 14, while maintaining the center of reciprocation such that none of the moving components contact the side walls 22 of the shaking device 10.

The shaking device 10 can be manufactured at low cost. Thus, the device is within the means of most PD patients. In addition, the small size and relative light weight make the device portable, which adds certain advantages.

Figure 5:
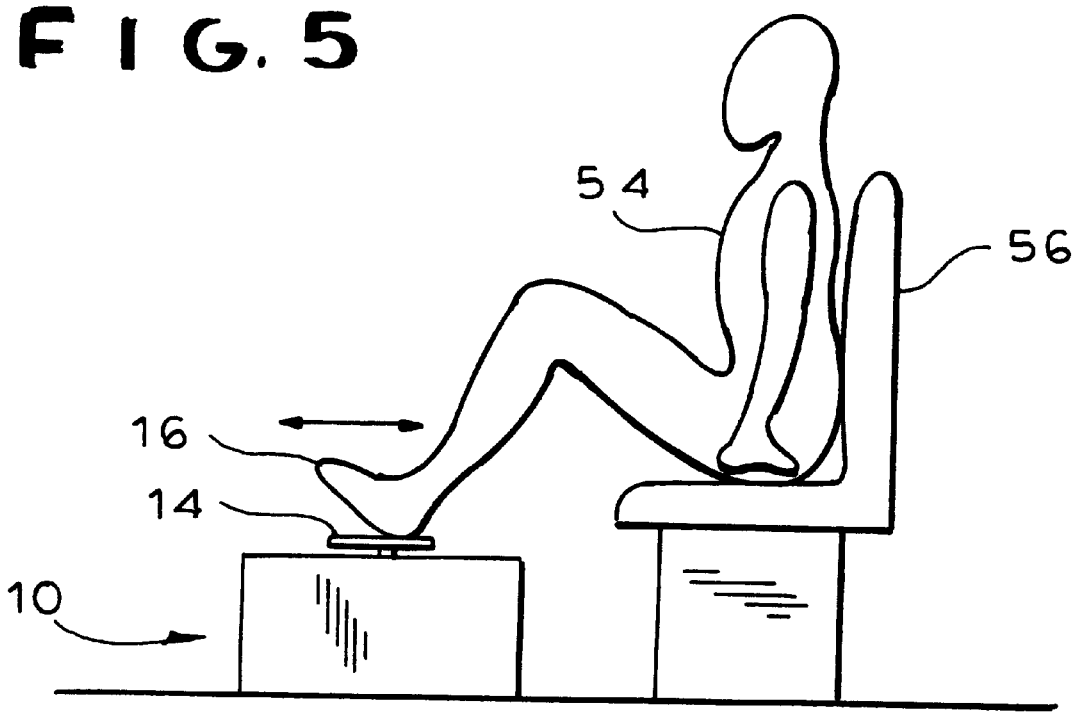
FIGS. 5 and 6 are side views of the shaking device in use.
Figure 6:
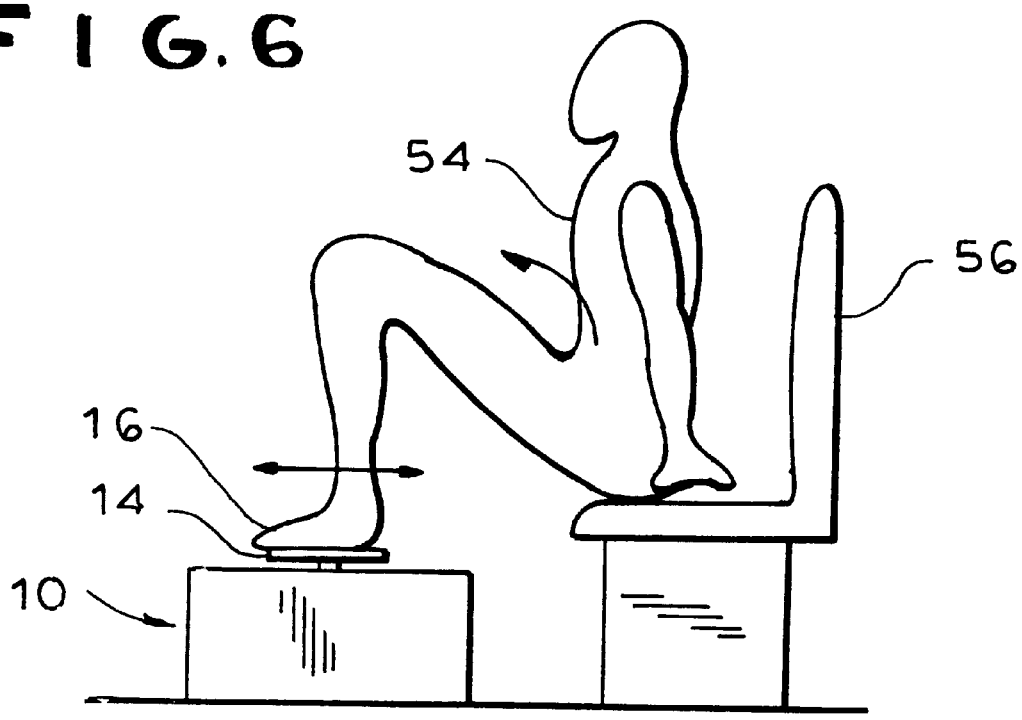

Referring to FIGS. 5–6, the method of the present invention involves employing the above-described shaking device 10 to induce indirect shaking and vibration to various points of a patient suffering from Parkinson's disease. In the method, the patient 54 is preferably placed or seated on a fixed support, such as a chair 56 with the shaking device 10 located in front of the patient 54 and oriented such that the motion of the foot support plate 14 is alternated toward and away from the patient 54. One or more of the patient's feet 16 are placed onto the foot support pad 14, and the shaking device 10 is activated thereby inducing shaking in the foot, ankle, and lower leg, and further into the body of the patient, depending on the position of the patient and the force supplied by the patient to the foot support pad 14. It can be appreciated that, if the patient is positioned as shown in FIG. 5, with only the ankle touching the foot support pad and the leg in an extended position, the movement induced by the shaking device 10 will be substantially contained in the foot, ankle and lower leg of the patient. However, if a patient is positioned as in FIG. 6, with the sole of the foot 16 placed on the foot support pad 14 and the torso of the patient 54 at or above the shaking device 10, the shaking induced in the patient 54 will travel through the leg and hip of the patient and into the torso. Thus, it can be appreciated that, by varying the position and orientation of the patient 54, the shaking induced in the patient 54 by the shaking device 10 can be directed to various parts of the body.

Alternatively, the shaking device 10 can be oriented such that the foot support pad 14 moves laterally with respect to the patient 54. In this manner, the patient can place one or both feet 16 on the foot support pad 14 for side to side shaking in a similar manner as described above. Optionally, the legs or ankles can be crossed to vary the effect of the treatment. In any case, the orientation and positioning of the shaking device 10 and patient 54 can be adjusted to direct the shaking induced in the patient to treat particular portions of the body. The method is administered for a period of time until relief from the symptoms of the disease is realized. In addition, the patient, during the treatment can offer resistance to the movement of the foot support pad 14 which has the effect of exercise and increased induced vibration.

Thus, it can be appreciated that the shaking device and method provide an inexpensive and effective means for treating the symptoms of Parkinson's disease. The design of the shaking device and the treatment method provide that the therapeutic shaking movement can be induced in various parts of the body and directed to specific portions thereof, such that the treatment can be adjusted to the specific needs of the patient. It should be understood, of course, that the specific form of the invention herein illustrated and described is intended to be representative only, adjustments and changes may be made therein without departing from the clear teachings of the disclosure. Accordingly, reference should be made to the following appended claims in determining the full scope of the invention.

What is claimed is:

1. A portable shaking device for inducing shaking in the body of a person through the foot for the treatment of symptoms of Parkinson's Disease, the shaking device comprising:

a housing with a top;

a support structure;

a substantially planar foot support pad located above said top of said housing, said foot support pad being slidably connected to said support structure and being suitable for receiving and supporting the foot to induce shaking in the body;

a motor rigidly connected to a support plate which support plate is slidably connected to said support structure;

said motor being connected to said foot support pad by a linkage, aid motor and linkage being, suitable to reciprocate said foot support pad in a linear, horizontal back-and-forth motion;

said motor and said support plate reciprocating in an opposite, complimentary motion with respect to said foot support pad to balance the motion of the foot support pad, and to reduce or eliminate vibration of the portable shaking device;

whereby the shaking device provides a portable, readily positionable, and substantially vibration-free device for the treatment of the symptoms of Parkinson's Disease.

2. A shaking device as in claim 1, wherein said top of said housing substantially covers said motor and linkage and includes a hole substantially covered by said foot support pad, and said foot support pad is connected to said linkage through said hole.

3. A shaking device as in claim 2 further comprising means to variably adjust the frequency of the reciprocation of said foot support pad.

4. A shaking device as in claim 2, wherein said foot support pad has a longitudinal axial length of about 18 inches and a lateral width of about 10 inches, said foot support pad reciprocates along said longitudinal axis at an amplitude of about 1½ inches, and said foot support pad is located about 7 inches above a surface upon which the shaking device is placed.

5. A shaking device as in claim 4, wherein said foot support pad further comprises a non-skid surface.

6. The portable shaking device of claim 1, further comprising means to dampen the reciprocity of said motor with respect to said support structure.

* * * * *